US005702541A

United States Patent [19]

Inokuti

[11] Patent Number: 5,702,541

[45] Date of Patent: Dec. 30, 1997

[54] HIGH MAGNETIC DENSITY, LOW IRON LOSS, GRAIN ORIENTED ELECTROMAGNETIC STEEL SHEET AND A METHOD FOR MAKING

[75] Inventor: Yukio Inokuti, Chiba, Japan

[73] Assignee: Kawasaki Steel Corporation, Japan

[21] Appl. No.: 567,779

[22] Filed: Dec. 5, 1995

[30] Foreign Application Priority Data

Dec. 5, 1994 [JP] Japan ..... 6-300894
Jun. 28, 1995 [JP] Japan ..... 7-161958

[51] Int. Cl.[6] ..... H01F 1/147

[52] U.S. Cl. ..... 148/308; 420/117

[58] Field of Search ..... 148/306, 307, 148/308; 420/117

[56] References Cited

U.S. PATENT DOCUMENTS 4,581,080 4/1986 Meguro et al. ..... 148/307

FOREIGN PATENT DOCUMENTS 0 047 129 A1 3/1982 European Pat. Off. .
0 147 659 A3 7/1985 European Pat. Off. .
0 184 891 A1 6/1986 European Pat. Off. .
0 588 342 A1 3/1994 European Pat. Off. .

*Primary Examiner*—John Sheehan
*Attorney, Agent, or Firm*—Austin R. Miller

[57] ABSTRACT

In a grain oriented electromagnetic steel sheet exhibiting high magnetic flux density and low iron loss, having a composition containing about 2.5 to 4.0 weight percent of Si, and about 0.005 to 0.06 weight percent of Al, and i) at least about 95 percent by area ratio of all crystal grains in the electromagnetic steel sheet are large secondary recrystallized grains each having a diameter of about 5 to 50 mm, each having an [001] axis within about 5° to the rolling direction of the sheet, and each having an [110] axis within about 5° to the normal direction of the sheet face, and ii) small grains, each having a diameter of about 0.05 to 2 mm, and each having about 2° to 30° of relative angle between the [001] axis of the small grains and the [001] axis of the large secondary crystallized grains, the small grains being located in the large secondary crystallized grains or at the grain boundaries. By adding Sb, or Sb and Mo to the steel, magnetic properties further improve.

5 Claims, 6 Drawing Sheets

SECONDARY GOSS GRAIN

SLIGHTLY DEVIATED FROM [001]

HIGH MAGNETIC DENSITY, LOW IRON LOSS, GRAIN ORIENTED ELECTROMAGNETIC STEEL SHEET AND A METHOD FOR MAKING

BACKGROUND OF THE INVENTION

1. Field of the Invention

The present invention relates to a grain oriented electromagnetic steel sheet which exhibits high magnetic flux density and low iron loss. In particular, the invention relates to a grain oriented electromagnetic sheet possessing excellent magnetic properties and a method for making the same which involves controlling the aggregate structure of secondary crystallization of silicon steel sheets.

2. Description of the Related Art

Grain oriented electromagnetic steel sheets have been predominantly used as iron cores of transformers and other electric equipment. These applications demand excellent magnetic properties, i.e. high magnetic flux density ($B_8$) and low iron loss ($W_{17/50}$).

In order to improve the magnetic properties of grain oriented electromagnetic sheets, it is important that the <001> axis of secondary recrystallized grains in the steel sheet be highly oriented in the rolling direction. Impurities and precipitates in the final products must also be reduced as much as possible.

Since N. P. Goss proposed the basic two-step rolling production method for grain oriented electromagnetic steel sheets, improved production methods which realize better magnetic flux density and iron loss values have been introduced virtually every year. As typical examples, Japanese Patent Publication No. 40-15644 discloses a method utilizing an AlN precipitation phase, while Japanese Patent Publication No. 51-13469 discloses the use of a small amount of Sb, St and/or S as inhibitors. Magnetic flux densities ($B_8$) exceeding 1.89 T have been achieved through these methods.

However, these methods are not without problems. The method utilizing the AlN precipitation phase suffers from a relatively high iron loss due to coarsening of secondary recrystallized grains after the finishing annealing. To address this shortcoming, a method for improving (lowering) iron loss has been proposed in Japanese Patent 54-13846 in which secondary recrystallized grains are made fine through a high rolling-reduction warm rolling which is conducted between cold rollings. Products having an iron loss ($W_{17/50}$) of less than 1.05 W/kg have been produced through this method. Still, acceptably low iron loss is not always realized through this method, especially considering the relatively high magnetic flux density of the product. Further, the warm rolling step is performed by coil annealing, and thus is not an economical industrial production method. Therefore, this method does not provide a stable production process which produces consistently excellent magnetic properties.

The above-mentioned method utilizing a small amount of Sb, Se and/or S, which was discovered by the inventor of the present invention, can provide products having a magnetic flux density ($B_8$) of more than 1.90 T and an iron loss ($W_{17/50}$) of less than 1.05 W/kg. However, contemporary applications demand an even lower iron loss from grain oriented electromagnetic steel sheets.

Demand for reduced electric power loss has increased rapidly since the energy crisis, which in turn requires further improvement in iron core materials. More closely orienting each crystal grain to the ideal crystal orientation with {110}<001> would clearly provide a better iron core material.

I have carefully studied the orientation distribution of secondary recrystallized grains as well as primary recrystallized grains in silicon steel sheet by utilizing a recently-developed technique. Prior to this novel method, conventional theoretical methodology had been developed by using only phenomenalistic studies in which the secondary recrystallization mechanism was determined by observing the change of the aggregating texture using X-rays. However, I have developed a transmission Kossel instrument using a scanning electron image (disclosed in Japanese Patent Laid-Open No. 55-33660, and Japanese Utility Model Laid-Open No. 55-38349), and with it measured the orientation of small crystal grains within a micro-area of approximately 5 to 20 μm. Measurements were taken from samples extracted at each production step from hot rolling through decarburization/primary recrystallization annealing. The orientation of secondary recrystallized grains during secondary recrystallization and after secondary recrystallization annealing has also been closely studied.

We have clarified the mechanism behind the propagation of predominantly Goss oriented, secondary recrystallized grains (also referred to as secondary Goss grain(s)) through a computer color mapping method. An image analyzer was used to convert the crystal orientation data into a crystal orientation map.

The transmission Kossel instrument, developed by inventor of the present invention, can effectively measure crystal orientation by the Kossel method. In the present invention, the angle of the steel sheet to the rolling direction, RD, and the angle of the steel sheet to the normal direction, ND, represent conical solid angles RD and ND, respectively.

The results of the studies are summarized as follows:

(1) Secondary Goss nuclei, which predominantly propagate secondary recrystallized grains, occur in a micro area having the exact Goss orientation near the surface of hot rolled sheet. The Goss nuclei change from (110)<001> to (111)<112> orientation during cold rolling, and return to (110)<001> orientation during recrystallization annealing. By virtue of this structural memory, the Goss nuclei possess the (110)<001> orientation in the sheet after decarburization and primary recrystallization annealing, prior to secondary recrystallization.

(2) Primary recrystallized grains in the Goss orientation form clusters near the surface of the sheet after decarburization and primary recrystallization annealing. The average area of the clusters is two to six times that of the average size of the primary recrystallized grains.

(3) The secondary recrystallized nuclei with the Goss orientation, which predominantly occur near the steel sheet surface during the subsequent secondary recrystallization annealing, form a large secondary Goss grain by consuming the small primary recrystallized grains having other orientations.

(4) The crystal orientation of secondary recrystallized grains in a grain oriented silicon steel sheet containing small amounts of Se, Sb, and Mo was observed through the computer color mapping method. Remarkably, I discovered that when large secondary Goss grains and small crystal grains are present together, the secondary recrystallized grains orient in the (110) plane direction with the orientation of [001] axis being slightly deviated. Conversely, when only large secondary Goss grains exist, the secondary recrystallized grains deviate from the (110) plane orientation by 10° to 15°, yet substantially orient along the [001] axis.

(5) From the study of the crystal orientation of secondary recrystallized grains in grain oriented silicon steel sheet containing small quantities of (a) Se and Al, (b) Se, Sb, and Al, (c) Se, Sb, Mo, and Al, as observed through the computer color mapping method, I discovered that low iron loss steel can be produced by predominantly forming small crystal grains rotating in the (110) plane in the matrix of a secondary recrystallized grain in the Goss orientation or at a boundary of secondary recrystallized grains possessing the Goss orientation. Further, I found that samples which exhibited poor magnetic properties formed aggregates of small grains in the (111) plane, and in addition exhibited secondary recrystallized grains having Goss orientation which were slightly deviated from the [001] axis direction and which were rotated by about 10° in the plane.

The Kossel method and the computer color mapping method, as described above, were utilized in these groundbreaking studies. Among the remarkable results observed, the results described in item (5) are particularly pertinent to the realization of extremely low iron loss.

Based on the findings described in item (5), I have intensively studied the production of electromagnetic steel sheet with low iron loss. As a result, I have discovered an electromagnetic sheet which possesses magnetic properties superior to any conventional sheet. This remarkable sheet is produced by controlling the secondary recrystallized aggregate texture by means of an improved inhibitor composition and a novel manufacturing process.

SUMMARY OF THE INVENTION

It is an object of the invention to provide a grain oriented electromagnetic steel sheet possessing high magnetic flux density and low iron loss, having a composition containing about 2.5 to 4.0 weight percent of Si, and about 0.005 to 0.06 weight percent of Al, the steel sheet comprising:

i) large secondary recrystallized grains having a diameter of about 5 to 50 mm comprising at least about 95 percent by area ratio of crystal grains in the electromagnetic steel sheet, the large secondary recrystallized grains having the [001] axis within about 5° of the rolling direction of the sheet, and having the [110] axis within about 5° of the normal direction of the sheet face; and ii) small grains, having a diameter of about 0.05 to 2 mm, and having the [001] axis at an angle of about 2° to 30° relative to the [001] axis of said large secondary recrystallized grains, the small grains being positioned in said large secondary recrystallized grains or at the grain boundary.

It is another object of the invention to provide a grain oriented electromagnetic steel sheet possessing high magnetic flux density and low iron loss, having a composition further containing about 0.005 to 0.2 weight percent of Sb, in addition to about 2.5 to 4.0 weight percent of Si, and about 0.005 to 0.06 weight percent of Al.

It is a further object of the invention to provide a grain oriented electromagnetic steel sheet possessing high magnetic flux density and low iron loss, having a composition further containing about 0.005 to 0.2 weight percent of Sb, and about 0.003 to 0.1 weight percent of Mo, in addition to about 2.5 to 4.0 weight percent of Si, and about 0.005 to 0.06 weight percent of Al.

In these embodiments of the invention, outstanding magnetic properties can be achieved when the crystal orientation of the small grains, expressed by angles $\alpha$, $\beta$, and $\gamma$, satisfies the following relations:

$\alpha \geqq$ about 2°, $\alpha \geqq$ about $1.5\beta$, and $\alpha \geqq$ about $1.5\gamma$.

It is still another object of this invention to provide a method for producing a grain oriented electromagnetic steel sheet possessing high magnetic flux density and low iron loss, comprising:

hot rolling a slab for an oriented electromagnetic steel sheet, the steel having a composition including about 2.5 to 4.0 weight percent of Si, and about 0.005 to 0.06 weight percent of Al;

finishing the hot-rolled sheet to a final product thickness by one cold-rolling step or two cold-rolling steps with an intermediate annealing step between the cold-rolling steps;

performing a decarburization and primary recrystallization annealing step thereto;

applying an annealing separation agent substantially comprising MgO on the steel sheet surface;

and applying a finishing annealing step comprising secondary recrystallization annealing and purification annealing:

in which the steel sheet is rapidly heated at a rate of 10° C./min or more from 450° C. to a predetermined constant temperature ranging from 800° to 880° C. in said decarburization and primary recrystallization annealing step; and a nitriding step is applied in a nitrogen atmosphere having a dew point of −20° C. or less in the second half stage of the decarburization and primary recrystallization annealing step.

It is still a further object of this invention to provide a method for producing a grain oriented electromagnetic steel sheet with high magnetic flux density and low iron loss, comprising: applying a hot-rolling step to a slab for an oriented electromagnetic steel sheet having a composition containing about 2.5 to 4.0 weight percent of Si, and about 0.005 to 0.06 weight percent of Al;

finishing thereof to a final product thickness by one cold-rolling step or two cold-rolling steps with an intermediate annealing step between the cold-rolling steps;

applying a decarburization and primary recrystallization annealing step thereto;

painting an annealing separation agent mainly containing MgO on the steel sheet surface; and applying a finishing annealing step comprising secondary recrystallization annealing and purification annealing:

in which the steel sheet is rapidly heated at a rate of 10° C./min or more from 450° C. to a predetermined constant temperature ranging from 800° to 880° C. in said decarburization and primary recrystallization annealing step; and a nitriding step is applied in a nitrogen atmosphere having a dew point of −20° C. or less after said decarburization and primary recrystallization annealing step and before said finishing annealing step.

In each method described above, it is desirable that the increase in the N concentration on the surface layer of the steel sheet, by the nitriding step applied during the second half step of the decarburization step or after the decarburization step, is approximately 20 to 200 ppm.

According to the present invention, an electromagnetic steel sheet having incomparable magnetic properties, both high magnetic flux density and low iron loss is obtainable.

DETAILED DESCRIPTION OF THE PREFERRED EMBODIMENTS

The present invention will now be explained in detail, beginning with the experimental results which led to the discovery of this invention.

A silicon steel slab, having a composition comprising 0.068 weight percent of C, 3.34 weight percent of Si, 0.076 weight percent of Mn, 0.030 weight percent of Sb, 0.012 weight percent of Mo, 0.025 weight percent of Al, 0.019 weight percent of Se, 0.004 weight percent of P, 0.003 weight percent of S, 0.0072 weight percent of N, and the balance substantially Fe, was heated at 1380° C. for 4 hours to separate and dissolve inhibitors in the silicon steel, and then was hot rolled to a hot-rolled plate 2.2 mm thick. After homogenizing annealing at 1050° C., the plate was finished to a thickness of 0.23 mm by two cold-rollings with an intermediate annealing at 1030° C. between the cold-rollings. Warm rolling at 250° C. constituted the second rolling.

Then, decarburization and primary recrystallization annealing was performed on the cold-rolled sheet at 840° C. in a humid hydrogen atmosphere having a dew point of 50° C. During the decarburization and primary recrystallization annealing, the sheet was rapidly heated at a rate of more than 10°/min in a recovery and subsequent recrystallization temperature region of 450° C. to 840° C.

Further, during the second half of the decarburization and primary recrystallization annealing, nitriding was performed on the steel sheet surface in a nitrogen atmosphere having a dew point of −20° C. or less so as to enhance the nitrogen concentration of the steel sheet surface while preventing oxidation.

Then, after painting an annealing separation agent mainly containing MgO on the steel sheet surface, the secondary recrystallizing annealing was performed at 850° C. for 15 hours. Secondary recrystallized grains, highly oriented in the Goss direction, were subsequently propagated by raising the temperature to 1050° C. at 10° C./min. Thereafter, a purification annealing was conducted at 1200° C.

The magnetic properties of the sheet product obtained were superb:

$B_8$=1.969 T, and $W_{17/50}$=0.79 W/kg.

Then, after micro strain was applied to the sheet product with plasma irradiation at an interval of 8 mm in the normal direction to the rolling direction, the iron loss was further improved:

$B_8$=1.969 T, and $W_{17/50}$=0.67 W/kg.

Thereafter, the orientation of the secondary recrystallized grains in the sheet product was measured using the Kossel method, and computer color maps of the orientation data were obtained through an image analyzer.

Figure 2:
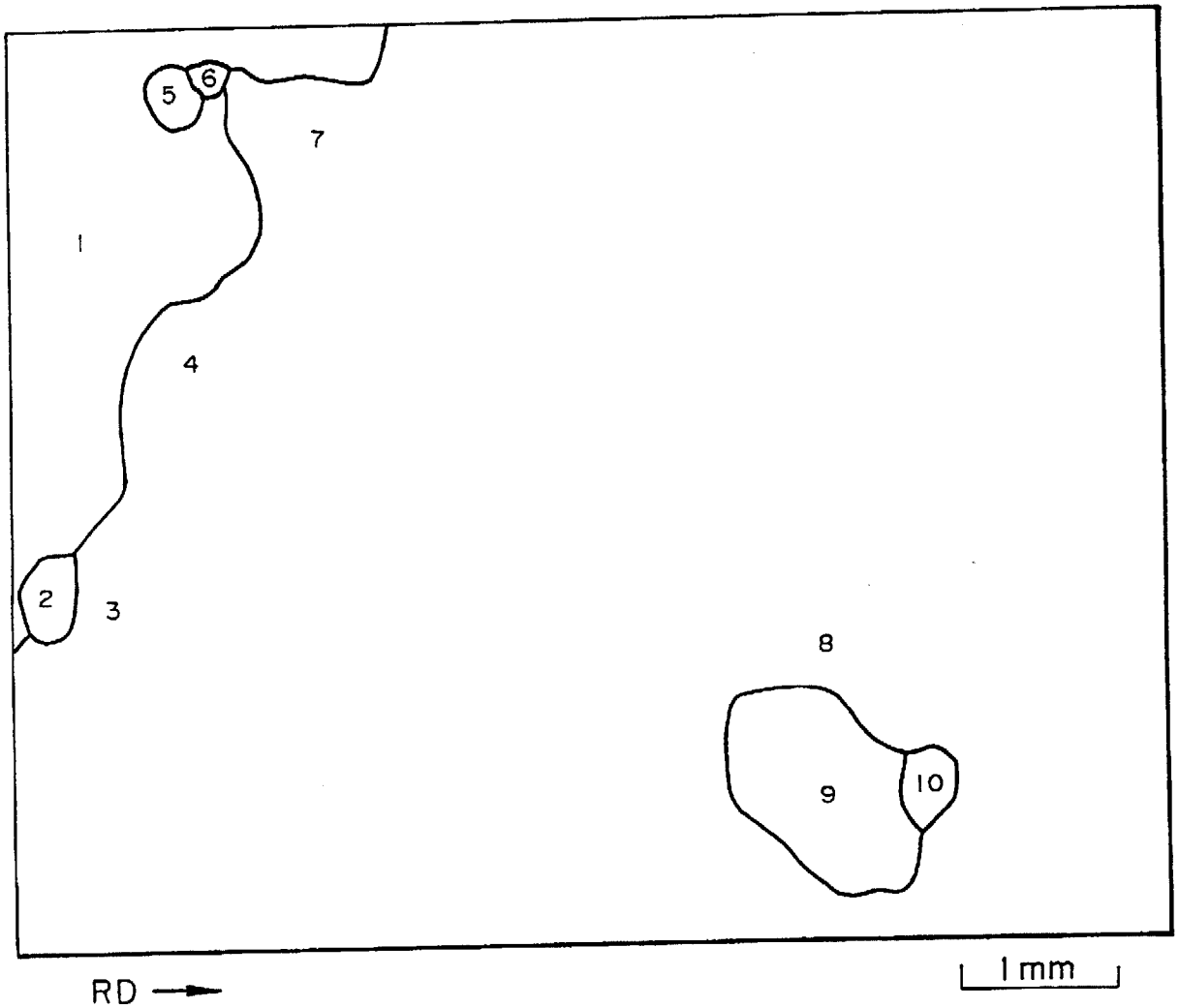
FIG. 2 is a schematic diagram illustrating an example of computer color mapping of the steel sheet of the present invention.

FIG. 2 is a schematic diagram of a typical computer color map illustrating crystal boundary between a secondary recrystallized grain with Goss orientation and adjacent secondary recrystallized grains in the sheet product. In this sample, five small crystal grains of approximately 0.2 to 1.4 mm, marked with the numbers "2", "5", "6", "9", and "10" in FIG. 2, formed either in a large secondary recrystallized grain of 35.7 mm with Goss orientation, or along the grain boundary.

Figure 1:
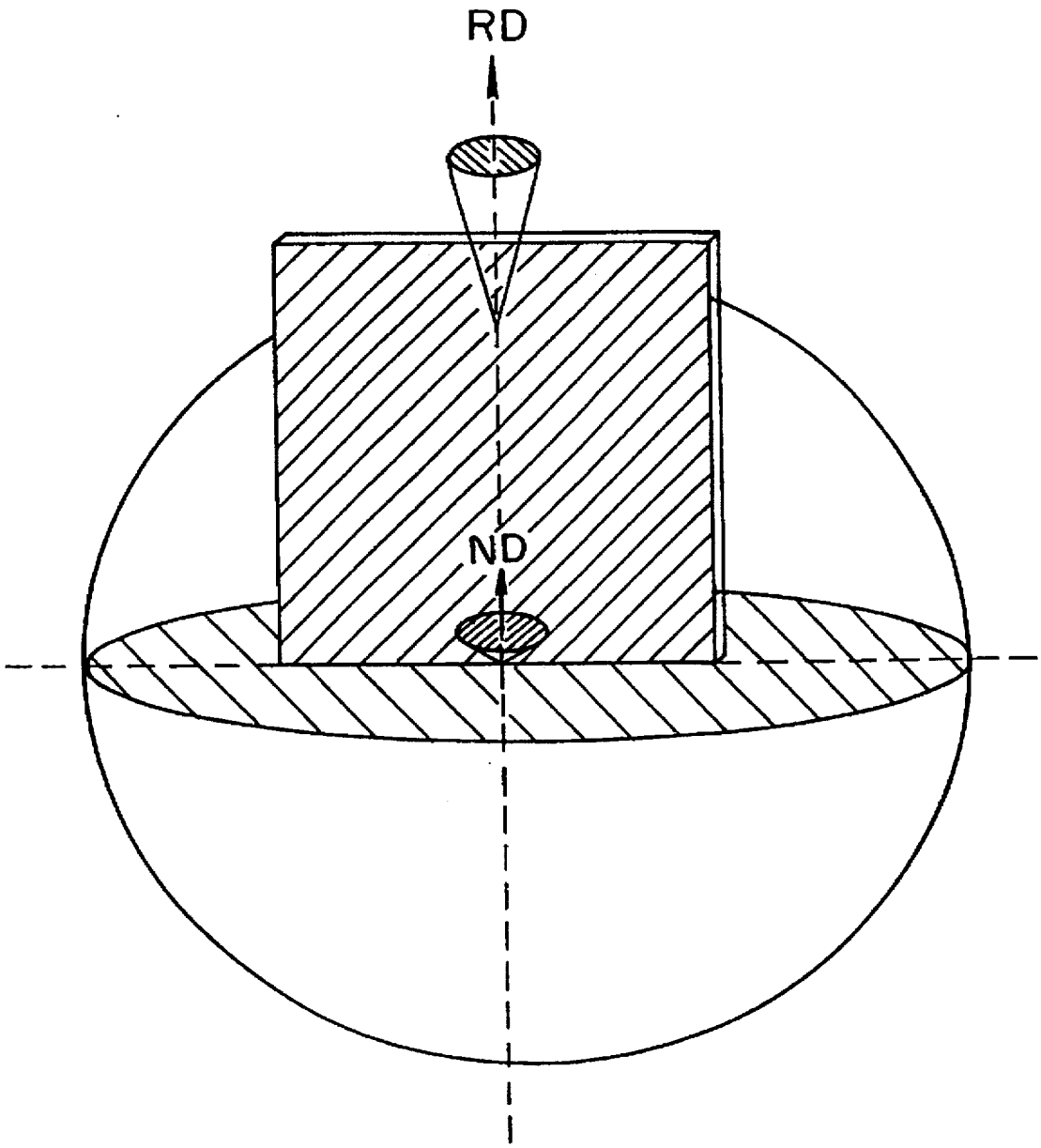
FIG. 1 is a schematic representation of solid angles rotating the rolling direction, RD, and normal direction of the sheet plane, ND of the steel sheet.
Figure 3:
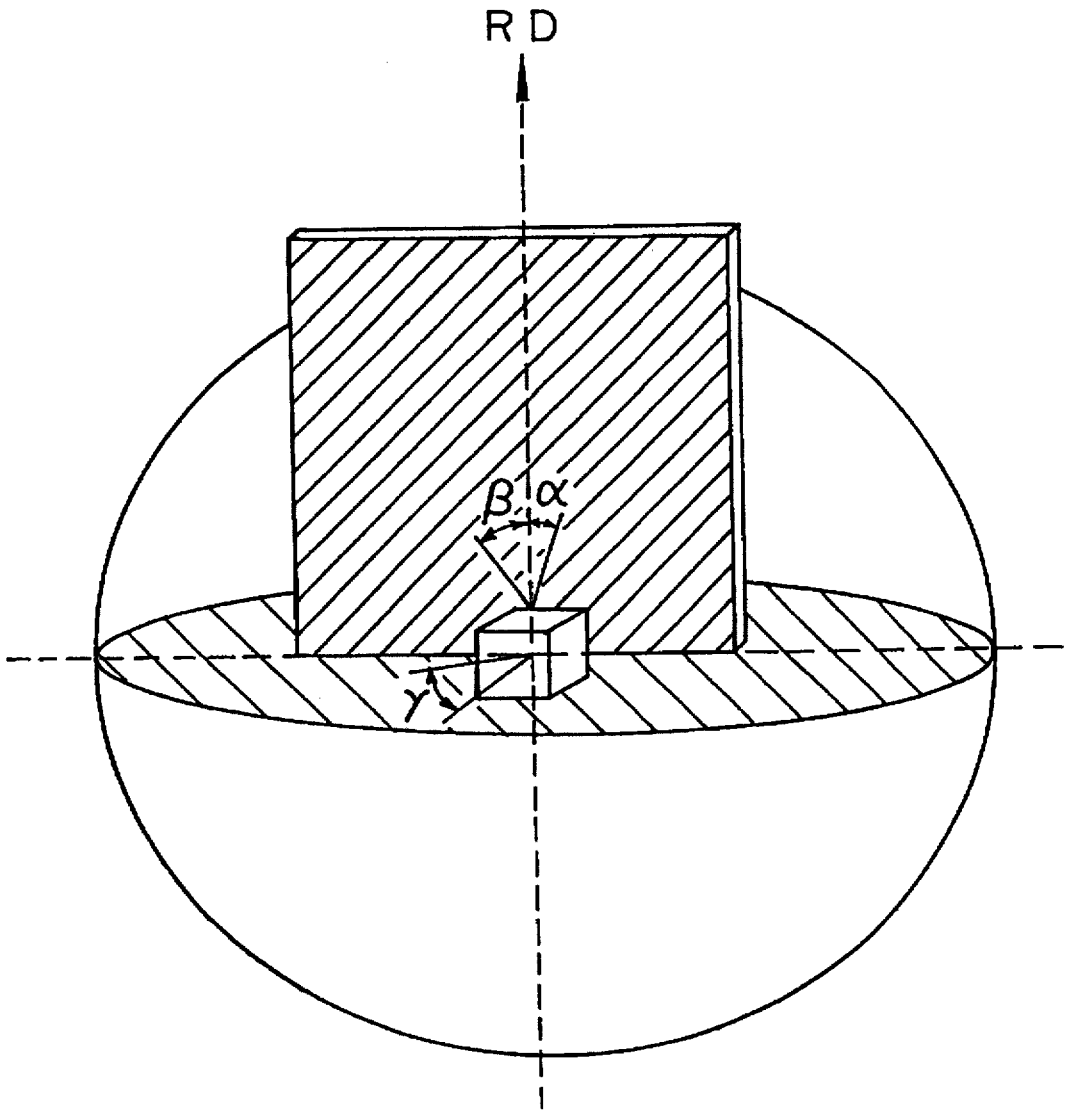
FIG. 3 is a schematic representation of orientation expression defined by angles α, β, and γ.

The crystal orientation of the electromagnetic steel sheet often can be defined more accurately by measuring an angle in a parallel plane to the steel sheet plane, α, an angle in a plane which is normal to the steel sheet plane and includes RD, β, and an angle in a plane normal to the above two planes, γ, as shown in FIG. 3, rather than defining orientation with the solid conical angles RD and ND as shown in FIG. 1. This is because the majority of the large secondary recrystallized grains in the invention are very close to Goss orientation. Therefore, the crystal orientation of the electromagnetic steel sheet can be more accurately expressed through the angles α, β, and γ.

Notably, the orientation of the large secondary recrystallized grains shown in FIG. 2 is −1.0° for α, 0° for β, and −1.0° for γ, thus indicating that the secondary grains have almost ideal Goss orientation. In contrast, the five small secondary recrystallized grains in FIG. 2 do not possess the predominant orientation. The averages α, β, and γ of those five small recrystallized grains are 14.5°, 8.9°, and 9.6°, respectively. It is noteworthy that α is nearly twice as large as β and γ.

The orientation of crystal grains in a conventionally produced electromagnetic steel sheet was measured using the Kossel method. For this sample, the above specified nitriding step after decarburization and primary recrystallization annealing was not performed, and the heat treatment at 850° C. was also eliminated from the secondary recrystallization annealing. Instead, the propagation of the secondary recrystallized grains with Goss orientation was conducted by heating from 850° C. to 1050° C. at a rate of 10° C./hour alone. The conventional sheet product was also purification annealed at 1200° C.

The magnetic properties, magnetic flux density and iron loss of the conventional sheet product were inferior to those of the sheet product of the present invention. The measured values for the conventional product were:

$B_8$=1.895 T, and $W_{17/50}$=0.88 W/kg.

Figure 4:
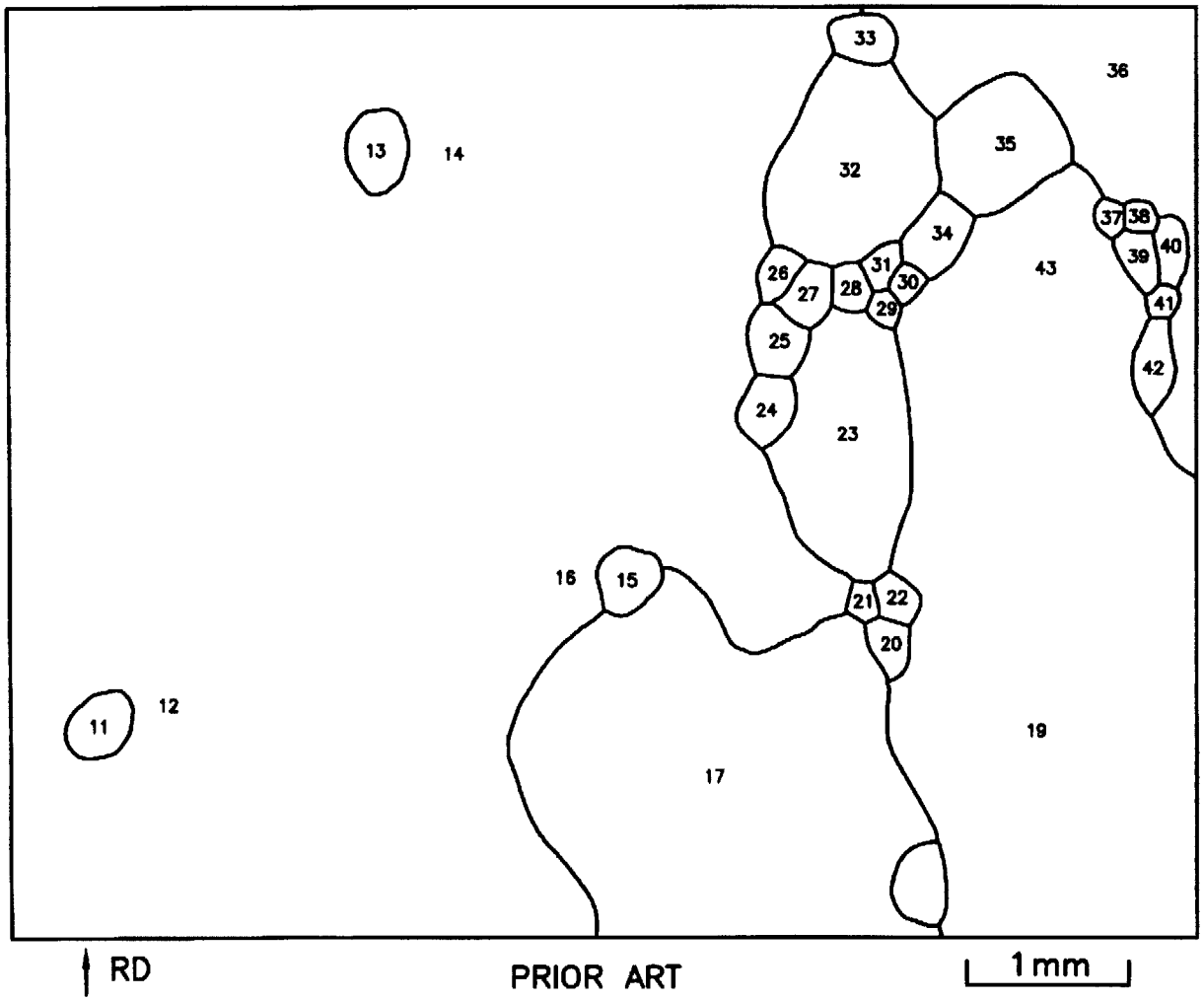
FIG. 4 is a schematic diagram demonstrating an example of computer color mapping of a conventionally-produced steel sheet.

FIG. 4 is a schematic diagram of a typical computer color map illustrating crystal boundaries between a secondary recrystallized grain with Goss orientation and adjacent secondary recrystallized grains in a conventionally-produced sheet product. FIG. 4 shows many small crystal grains of 0.2 to 1.0 mm formed as aggregates and surrounded by two large secondary Goss grains (α=1.5°, β=0.5° and γ=2.0°). The large secondary Goss grain partially shown in upper-left of FIG. 4 is 21 mm in diameter, while the large secondary Goss grain partially shown in lower-right of FIG. 4 is 32 mm in diameter.

Many small crystal grains are shown in FIG. 4 which have the (111) plane parallel to the sheet plane, namely those marked with the numbers "18", "21", "22", "25", "27", "28", "29", "31", "34", and "38." Other small grains are shown in FIG. 4 which have the [110] axis in the RD direction, namely those marked with the numbers "18", "20", "25", and "42."

These results clearly demonstrate that an electromagnetic steel sheet having high magnetic flux density and low iron loss is obtainable by predominantly forming small crystal grains in which each [001] axis slightly deviates from the [001] axis of the large secondary recrystallized grains, i.e. each (110) plane rotates on the [001] axis, in the large secondary Goss grains or at the grain boundary.

The formation of the secondary recrystallized grains in silicon steel sheets containing a small amount of (a) Se and Al, (b) Se, Sb, and Al, or (c) Se, Sb, Mo, and Al (see item (5) above), has been shown to differ sharply from the formation seen in silicon steel sheet containing a small amount of Se, Sb, and Mo (see item (4) above). This extreme difference is due to the low strength of the aggregate texture having Goss orientation near the hot rolled sheet surface in the steels of item (5) relative to the steels of item (4). The slight strength differences in the intermediate steps cause extreme differences in the propagation of the secondary recrystallized grains. That is, in the hot-rolled steel sheets of item (5), the mechanism for maintaining the Goss orientation of the aggregate texture, i.e. the structure memory effect, is poor. Thus, the secondary crystallized grains become larger, and the iron loss is too high for the high magnetic flux density. The present invention avoids this problem.

This issue will be further explained below.

The cause of the relatively low iron core loss exhibited in the invention is the propagation of small crystal grains of approximately 0.2 to 0.4 mm in the large secondary recrystallized grain or along the grain boundary, as shown in FIG. 2. Further, it should be noted that the five small crystal grains shown in FIG. 2 are oriented with high β values and low β and γ values. The preferential formation of the small crystal grains, in which the (110) plane rotates on the [001] axis and in which the small crystal grains are formed in a secondary recrystallized grain matrix or at grain boundaries, results in low iron loss. This remarkable effect occurs even with large secondary Goss grains.

Accordingly, the low iron loss can be effectively achieved by predominantly forming small grains in which the (110) plane rotates on the [001] axis, and by avoiding the formation of small grains in the (111) plane, in the matrix of a secondary recrystallized grain with Goss orientation or at grain boundaries.

In the invention, only the angle α of the angles α, β and γ possesses a large value. From an analysis of the relationships between the secondary recrystallized grains with Goss orientation, the MnSe precipitate, and predominant orientation and lattice constant of the small grain as shown in FIG. 5, the large α value can be explained as follows.

Figure 5:
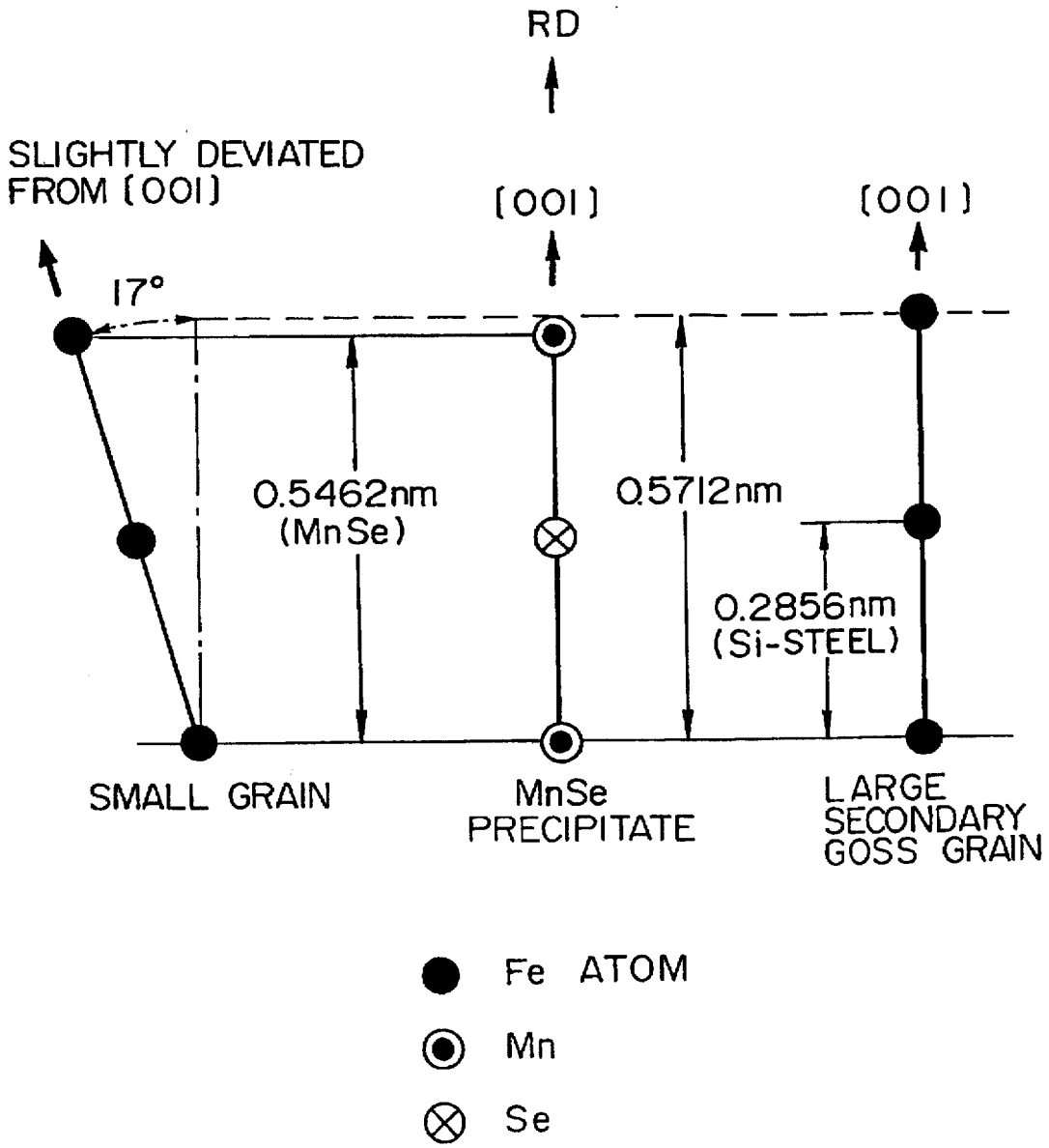
FIG. 5 is a schematic diagram illustrating the relation between large secondary Goss grain, MnSe precipitate, and predominant orientation and lattice constant of the small grains.

As seen in FIG. 5, each lattice constant in the [001] axis direction of the unit cells of two large secondary recrystallized grains is 2×0.2856 (nm)=0.5712 (nm). On the other hand, the relative arrangement of MnSe precipitate to the matrix, shown in the middle of FIG. 5, is $(012)_{MnSe}//(110)\alpha$, and $[100]_{MnSe}//[001]\alpha$, as reported in Journal of the Japan Institute of Metals, Vol. 49, No. 1, page 15, (1985); it is thought that in crystal grains with Goss orientation, small precipitates of MnSe form stably in the [100] axis direction. It can be seen that the lattice constant of [001] axis direction of the MnSe precipitates, shown in the middle of FIG. 5, is 0.5462 (nm), and is somewhat smaller than the lattice constant of the [001] axis direction in the two large secondary Goss grains. It should be noted that the schematic diagram of the small grain, shown in the left of FIG. 5, suggests that the lattice constant of the small grain becomes the same as the lattice constant of the MnSe precipitate by rotating approximately 17° from the [001] axis, i.e. by α rotation. Primary grains, which exhibit a 17° α rotation only, are well-stabilized by MnSe precipitation. As primary grains are consumed very little by the secondary Goss grains, the separation and dissolving of MnSe precipitate in the primary grains are reduced as compared with crystal grains having other orientations.

Figure 6A:
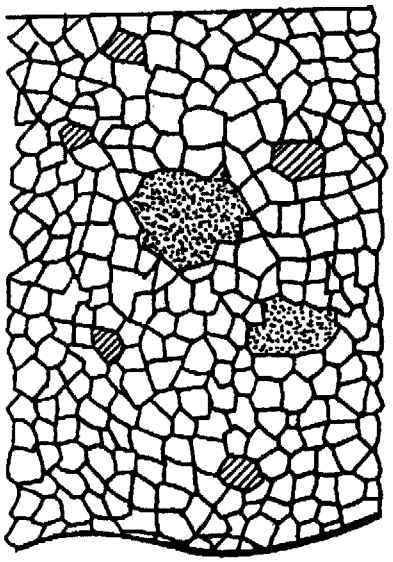
FIGS. 6A, 6B and 6C are schematic diagrams illustrating small crystal grains which are slightly deviated from [001] axis and which are enveloped but not consumed by the secondary Goss grain at the initial stage of secondary recrystallization annealing.
Figure 6B:
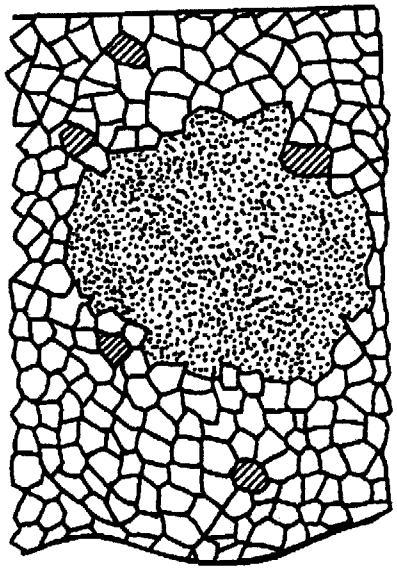
Figure 6C:
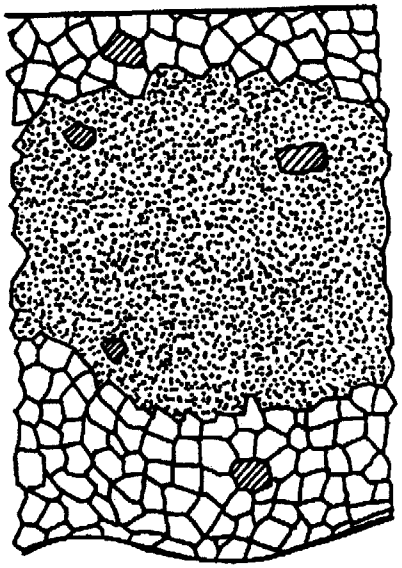

FIG. 6(*a*), (*b*), and (*c*) schematically and sequentially show the process in which small grains slightly deviated from [001] axis remain unconsumed by the secondary Goss grain at the initial stage of secondary recrystallization annealing. FIG. 6 demonstrates that the small crystal grains slightly deviated from [001] axis (shaded in the figure) are enveloped but not consumed by the secondary Goss grain. The MnSe precipitate shown in FIG. 5 stably precipitates in the shaded small crystal grains, and will separate and dissolve at a slower rate as compared with crystal grains having other orientations.

The quantities of the components used in the steel sheet of the present invention will now be explained.

Si: about 2.5 to 4.0 weight percent.

Since a steel sheet containing less than about 2.5 weight percent Si has low electric resistance, eddy current loss increases, resulting in increased iron loss. On the other hand, when Si content exceeds about 4.0 weight percent, brittle fracture readily occurs. Therefore, Si content is limited to the range from about 2.5 to 4.0 weight percent.

Al: about 0.005 to 0.06 weight percent.

Al forms fine AlN precipitates by combining with N present in the steel sheet. AlN precipitates effectively act as strong inhibitors. An Al content of less than about 0.005 weight percent does not permit the formation of sufficient quantities of fine AlN precipitates, thus secondary grains fail to propagate sufficiently in the Goss direction. Likewise, an Al content of more than about 0.06 weight percent causes insufficient propagation of Goss grains. Therefore, Al content is limited to the range from about 0.005 to 0.06 weight percent.

In the present invention, Sb and Mo may be incorporated in the steel sheet in addition to Si and Al in order to further stabilize the large secondary Goss grains.

Sb: about 0.005 to 0.2 weight percent.

Sb depresses normal propagation of the primary crystal grains and promotes the propagation of the secondary crystal grains with {110}<001> orientation after decarburization and primary recrystallization annealing and during secondary recrystallization annealing, thereby improving the magnetic properties of the steel sheet. Therefore, Sb is preferably used as an inhibitor in conjunction with AlN, as well as with MnSe and MnS as described below. However, Sb content of less than about 0.005 weight percent does not effectively produce the inhibition effect. On the other hand, a content of more than about 0.2 weight percent not only causes poor cold rolling formability, but also deteriorates the magnetic properties of the sheet. Thus, an Sb content ranging from about 0.005 to 0.2 weight percent is utilized in the invention.

Mo: about 0.003 to 0.1 weight percent.

Mo, like Sb, is a useful element for depressing the normal propagation of primary crystal grains. However, Mo content of less than about 0.003 weight percent does not effectively produce the inhibition effect. On the other hand, a content of more than about 0.1 weight percent causes poor cold rolling formability and poor magnetic properties in the sheet. Thus, Mo content is controlled to about 0.003 to 0.1 weight percent in the invention.

Mn: about 0.02 to 0.2 weight percent.

Mn is a useful element for forming MnSe and MnS inhibitors, as described below. Mn also effectively promotes improved brittleness during hot rolling, as well as improved cold rolling formability. A Mn content of less than about 0.02 weight percent does not produce the inhibition effect. On the other hand, a content of more than about 0.2 weight percent deteriorates the magnetic properties of the sheet. Thus, it is preferred that Mn content range from about 0.02 to 0.2 weight percent.

The invention further preferably contains approximately 0.005 to 0.05 weight percent of Se and S, and approximately 0.001 to 0.020 weight percent of N as inhibitor forming elements, as well as approximately 0.005 to 0.10 weight percent of C. Both Se and S form fine precipitates with Mn in the steel, and these precipitates act as strong inhibitors much like AlN. Further, C greatly contributes to making fine the crystal grains and the control of texture by γ modification. However, these components are removed from the steel sheet during purification annealing.

In the invention, it is essential that at least about 95% of the crystal grains are large secondary crystal grains each having a diameter of about 5 to 50 mm, and each having the [001] axis within about 5° to the rolling direction, RD, and the (110) plane within about 5° to the normal direction, ND, of the sheet plane (in other words, (110) plane tilts within about 5° of the sheet plane). This structure is critical for the following reasons.

First, the orientation of the [001] axis within about 5° to the rolling direction (RD) and the (110) plane within about 5° to the normal direction (ND) of the sheet plane ensures that the grain orientation is close to Goss orientation. Thus, it is preferable that both the deviation of the [001] axis to the rolling direction and the deviation of the [110] axis to the normal direction of the sheet plane are within about 3°.

When the content of such Goss oriented grains is less than about 95%, the magnetic properties, in particular magnetic flux density, do not improve sufficiently. Thus, in the present invention, the percentage of Goss oriented grains should be at least about 95%. In addition, the particle size of the Goss oriented grains is about 5 to 50 mm, and preferably about 10 to 20 mm, because when the particle size is less than about 5 mm or more than about 50 mm, iron loss improvement is diminished.

Further, when the relative angle of the [001] axis of the small crystal grains to the [001] axis of the large secondary grains is outside of the range of about 2° to 30°, satisfactory improvement in the iron loss cannot be expected. Therefore, this relative angle in the invention ranges from about 2° to 30°, preferably about 2° to 15°.

Moreover, it is preferable that the orientation of the small crystal grains expressed through angles α, β, and γ satisfies the relations $\alpha \geqq$ about 2°, $\alpha \geqq$ about 1.5β, and $\alpha \geqq$ about 1.5γ, because excellent magnetic properties can be achieved when these relations are satisfied. Preferable angle relations are $\alpha \geqq$ about 5°, $\alpha \geqq$ about 2.0β, and $\alpha \geqq$ about 2.0γ.

When the size of the small crystal grains is outside of the range of about 0.05 to 2 mm, iron loss does not improve sufficiently. Therefore, the size of the crystal grains in the invention ranges from about 0.05 to 2 mm, preferably about 0.1 to 1.0 mm.

A method for producing the steel sheet of the present invention will now be explained.

After forming a slab having a predetermined thickness from molten steel having a composition in accordance with the invention by continuous casting or ingot blooming, the slab is heated to between about 1,350° and 1,380° C. in order to completely dissolve inhibitor components such as Al, Se, and S. Then, after hot rolling and annealing (if necessary) to a hot-rolled steel plate, the steel plate is finished to a final product thickness of about 0.15 to 0.5 mm by one cold rolling step or two cold rolling steps with an intermediate annealing step.

Thereafter, a decarburization and primary recrystallization annealing is performed on the obtained sheet. Decarburization and primary recrystallization annealing is very important for obtaining a secondary recrystallized texture in accordance with the present invention. The decarburization and primary recrystallization annealing is carried out in a humid hydrogen atmosphere at about 800° to 880° C. for about 1 to 10 minutes. The decarburization and primary recrystallization annealing involves heating the steel sheet to a predetermined constant temperature in which a rapid heating rate of more than about 10° C./min. is employed from 450° C. (the recovering and recrystallizing temperature) to the predetermined constant temperature. A heating rate of less than about 10° C./min. does not cause enough primary crystal grain aggregates having {110}<001> orientation to form.

Moreover, it is essential that a nitriding is performed on the steel sheet in a nitrogen atmosphere having a low dew point. The nitriding can be performed during the second half of the decarburization and primary recrystallization annealing. The dew point of the atmosphere during nitridation should be less than about −20° C., because satisfactory improvement in the magnetic properties cannot be achieved at a dew point exceeding about −20° C. It should be noted that the N concentration at the steel sheet surface increases by 20 to 200 ppm through such nitriding. The secondary recrystallized texture essential to the invention is not obtainable without nitriding, even if the steel content and the heating rate during decarburization and annealing are in accordance with the invention. Although it is desirable in view of economics and stable production of high quality sheet that the decarburization and nitriding are continuously performed during decarburization and primary recrystallization annealing, both treatments may be performed during other production phases.

After applying an annealing separation agent substantially comprising MgO to the steel sheet surface, the sheet is annealed for secondary recrystallization at about 840° to 870° C. for about 10 to 20 hours. It is preferable that the sheet is heated from the above temperature to a temperature between approximately 1,050° to 1,100° C. at a heating rate of about 8° to 15° C./min immediately after the application of the annealing separation agent in order to propagate secondary grains which are highly oriented in the Goss direction. The sheet is also preferably annealed for purification at about 1,200° to 1,250° C. for about 5 to 20 hours.

Magnetic domain subdividing treatments such as plasma irradiation and laser irradiation may also be applied to the sheet product to lower iron loss.

The invention will now be described through illustrative examples. The examples are not intended to limit the scope of the invention defined in the appended claims.

EXAMPLE 1

As sample (a), a silicon steel slab comprising 0.068 weight percent of C, 3.44 weight percent of Si, 0.079 weight percent of Mn, 0.024 weight percent of Al, 0.002 weight percent of P, 0.002 weight percent of S, 0.024 weight percent of Se, 0.0076 weight percent of N, and the balance substantially Fe, was heated at 1,420° C. for 3 hours to separate and dissolve inhibitors in the silicon steel, and thereafter hot rolled to form a hot-rolled plate 2.3 mm thick. After homogenizing annealing at 1,020° C., the hot rolled plate was finished to a thickness of 0.23 mm by two cold rolling steps with an intermediate annealing at 1,050° C. The second rolling step was rolling at 250° C.

The cold rolled sheet was decarburization and primary recrystallization annealed at 850° C. in a humid hydrogen atmosphere, where rapid heating at a rate of 15° C./min. was carried out from 450° C. to 850° C. (850° C. represented the predetermined constant temperature). Further, during the second half of the decarburization annealing step, nitriding was carried out at 800° C. for 1.2 minutes in a nitrogen atmosphere having a dew point of −30° C., which increased the nitrogen concentration of the steel sheet surface by 80 ppm to 0.0145 weight percent.

After applying an annealing separation agent substantially comprising MgO on the steel sheet surface, the steel sheet was annealed for secondary recrystallization at 850° C. for 15 hours, then heated at a rate of 10° C./min from the annealing temperature to 1,050° C. to propagate secondary grains highly oriented in the Goss direction. The sheet was then annealed for purification at 1,200° C.

Then, for the production of sample (b), a similar process to that used for sample (a) was applied to a silicon steel slab comprising 0.074 weight percent of C, 3.58 weight percent of Si, 0.082 weight percent of Mn, 0.031 weight percent of Sb, 0.013 weight percent of Mo, 0.026 weight percent of Al, 0.003 weight percent of P, 0.002 weight percent of S, 0.019 weight percent of Se, 0.0065 weight percent of N, and the balance substantially Fe.

The magnetic properties of the sheet products obtained from the above process were evaluated, and the excellent results are as follows:

Sample (a) $B_8$=1.958 T, $W_{17/50}$=0.080 W/kg

Sample (b) $B_8$=1.969 T, $W_{17/50}$=0.078 W/kg.

Further, to the sheet product of sample (b), micro strain was incorporated every 8 mm in the direction normal to rolling direction by plasma irradiation. The magnetic properties were again evaluated, and showed further improvement:

$B_8$=1.966 T, $W_{17/50}$=0.068 W/kg.

The crystal orientations of samples (a) and (b) were measured using the Kossel method and analyzed by computer color mapping with an image analyzer.

In the sheet product from sample (a), seven small crystal grains, each having a grain size between 0.5 and 2.0 mm, formed in a large secondary Goss grain ($\alpha$=1.2°, $\beta$=0.5°, and $\gamma$=0.8°), or along the grain boundary. Average orientation angles of these seven small crystal grains were 16.8° for $\alpha$, 4.2° for $\beta$, and 6.8° for $\gamma$, with the $\alpha$ value being approximately 3 to 4 times greater than both $\beta$ and $\gamma$ values.

In the sheet product from sample (b), eight small crystal grains, each having a grain size between 0.2 and 1.4 mm, formed in a large secondary Goss grain ($\alpha$=−0.3°, $\beta$=0.2°, and $\gamma$=−0.9°), or along the grain boundary. Although these eight small crystal grains did not possess the specified predominant orientation, average orientation values were 15.5° for $\alpha$, 3.9° for $\beta$, and 4.8° for $\gamma$, with $\alpha$ value being approximately 4 times greater than both $\beta$ and $\gamma$ values.

EXAMPLE 2

Silicon steel slabs, each having a composition as shown in Table 1, were heated to 1,360° C., and hot rolled to hot-rolled plates 2.3 mm thick. Then, after homogenizing annealing at 1,000° C., the plates were finished to a sheet 0.23 mm thick by two cold rolling steps with an intermediate annealing step at 980° C.

Decarburization and primary crystallization annealing and nitriding under the conditions shown in Table 2 were performed on the cold rolled sheet. After applying an annealing separation agent substantially comprising MgO on the steel sheet surface, secondary recrystallization annealing was performed at 850° C. for 15 hours. Then each steel sheet was heated at a rate of 8° C./min. from 850° C. to 1,080° C., which was followed by a purification annealing at 1,200° C.

Table 3 shows the results of magnetic property evaluations performed on these sheet products, as well as measurements of large secondary Goss grain size, small secondary grain size, and crystal orientation as determined through computer color mapping. Table 3 reveals that the electromagnetic steel sheets of the present invention have magnetic properties superior to the sheets of comparative examples.

Although this invention has been described in connection with specific forms thereof, it will be appreciated that a wide variety of equivalents may be substituted for the specific elements described herein y without departing from the spirit and scope of the invention as defined in the appended claims.

TABLE 1

| | Composition (wt %) | | | | | | | | | |
|---|---|---|---|---|---|---|---|---|---|---|
| Samples | C | Si | Mn | Sb | Al | Mo | S | Se | N | Remarks |
| A | 0.065 | 3.41 | 0.082 | 0.019 | 0.022 | 0.013 | — | 0.019 | 0.0086 | Invention |
| B | 0.085 | 3.15 | 0.091 | 0.035 | 0.041 | — | — | 0.022 | 0.0090 | Invention |
| C | 0.049 | 3.31 | 0.072 | 0.015 | 0.020 | 0.019 | — | 0.025 | 0.0082 | Invention |
| D | 0.059 | 3.31 | 0.093 | 0.035 | 0.018 | 0.015 | 0.018 | 0.010 | 0.0068 | Invention |
| E | 0.071 | 3.20 | 0.065 | 0.021 | 0.026 | — | 0.015 | 0.009 | 0.0078 | Invention |
| F | 0.068 | 3.09 | 0.080 | 0.031 | 0.031 | 0.016 | — | 0.019 | 0.0069 | Invention |
| G | 0.079 | 3.53 | 0.083 | — | 0.029 | — | — | 0.024 | 0.0072 | Invention |

TABLE 2

| No. | Samples | Decarburization and primary recrystallization annealing: Heating rate (°C./min) | Heating temperature (°C.) | Dew point of atmosphere (°C.) | Nitriding: Heating temperature (°C.) | Dew point of atmosphere (°C.) | N increment (ppm) |
|---|---|---|---|---|---|---|---|
| 1 | A | 10 | 840 | +50 | 800 | −20 | 60 |
| 2 | B | 12 | 850 | +45 | 840 | −25 | 80 |
| 3 | C | 14 | 835 | +55 | 820 | −35 | 85 |
| 4 | D | 11 | 825 | −50 | 840 | −30 | 81 |
| 5 | E | 15 | 840 | +50 | 840 | −35 | 91 |
| 6 | F | 10 | 850 | +55 | 800 | −28 | 69 |
| 7 | B | 4 | 840 | +55 | — | — | — |
| 8 | D | 8 | 835 | +60 | — | — | — |
| 9 | F | 6 | 850 | +50 | — | — | — |
| 10 | G | 13 | 845 | +50 | 830 | −25 | 70 |

TABLE 3

| No. | Magnetic properties: $B_8$ (T) | $W_{17/50}$ (w/kg) | Orientation & Size of secondary Goss grain: α (°) | β (°) | γ (°) | Grain size (mm) | Orientation & Size of small grains: α (°) | β (°) | γ (°) | Grain size (mm) | Remarks |
|---|---|---|---|---|---|---|---|---|---|---|---|
| 1 | 1.97 | 0.78 | 1.5 | 0.5 | 0.9 | 15 | 8.2 | 0.3 | 4.3 | 0.8 | Invention |
| 2 | 1.97 | 0.77 | 2.0 | 0.6 | 1.2 | 16 | 10.2 | 5.1 | 3.2 | 0.09 | Invention |
| 3 | 1.98 | 0.75 | 1.6 | 0.8 | 1.6 | 20 | 3.9 | 0.4 | 2.1 | 1.0 | Invention |
| 4 | 1.96 | 0.79 | 2.8 | 1.1 | 1.0 | 12 | 5.6 | 3.1 | 3.1 | 0.9 | Invention |
| 5 | 1.96 | 0.80 | 0.9 | 1.0 | 1.0 | 15 | 2.9 | 2.1 | 2.0 | 1.2 | Invention |
| 6 | 1.97 | 0.77 | 0.7 | 0.5 | 0.5 | 13 | 8.9 | 0.4 | 1.6 | 1.5 | Invention |
| 7 | 1.94 | 0.85 | 3.0 | 0.8 | 1.2 | 20 | — | — | — | — | Comparative Example |
| 8 | 1.94 | 0.86 | 3.5 | 1.2 | 1.9 | 18 | — | — | — | — | Comparative Example |
| 9 | 1.95 | 0.84 | 2.5 | 0.9 | 2.1 | 15 | — | — | — | — | Comparative Example |
| 10 | 1.96 | 0.80 | 1.2 | 0.7 | 0.9 | 22 | 14.5 | 4.2 | 8.1 | 0.7 | Invention |

What is claimed is:

1. A grain oriented electromagnetic steel sheet exhibiting excellent magnetic flux density and excellent iron loss, said steel sheet having a rolling direction and a direction normal to said sheet, said steel sheet comprising:

about 2.5 to 4.0 weight percent of Si, and about 0.005 to 0.06 weight percent of Al; said steel sheet further comprising:

i) large secondary recrystallized grains each having a diameter of about 5 to 50 mm and comprising at least about 95 percent by area ratio of all crystal grains in said electromagnetic steel sheet, said large secondary recrystallized grains defining grain boundaries, said large secondary recrystallized grains each having a [001] axis and a [110] axis, said [001] axis being within about 5° to said rolling direction of said steel sheet and said [110] axis being within about 5° to said direction normal to said sheet; and ii) small grains each having a diameter of about 0.05 to 2 mm, said small grains each having a [001] axis which is at an angle of about 2° to 30° relative to said [001] axis of said large secondary recrystallized grains, said small grains being positioned in said large secondary recrystallized grains or at said grain boundaries defined by said large secondary recrystallized grains.

2. A grain oriented electromagnetic steel sheet according to claim 1, further comprising about 0.005 to 0.2 weight percent Sb.

3. A grain-oriented electromagnetic steel sheet according to any of claims 1–2, wherein said small grains have a crystal orientation defined by angles α, β, and γ such that the following relations are satisfied:

$\alpha \geqq$ about 2°, $\alpha \geqq$ about $1.5\beta$, and $\alpha \geqq$ about $1.5\gamma$, wherein α is defined as an angle relative to said rolling direction in a plane parallel to said steel sheet, β is defined as an angle relative to said rolling direction in a plane normal to said steel sheet, and γ is defined as an angle formed in a plane normal to said steel sheet and said plane normal to said steel sheet and being relative to an axis extending normal to said steel sheet and said direction normal to said steel sheet.

4. A grain-oriented electromagnetic steel sheet exhibiting excellent magnetic flux density and excellent iron loss, said steel sheet having a rolling direction and a direction normal to said sheet, said steel sheet comprising:

about 2.5 to 4.0 weight percent of Si, about 0.003 to 0.1 weight percent Mo, about 0.005 to 0.2 weight percent Sb, and about 0.005 to 0.06 weight percent of Al; said steel sheet further comprising:

i) large secondary recrystallized grains each having a diameter of about 5 to 50 mm and comprising at least about 95 percent by area ratio of all crystal grains in said electromagnetic steel sheet, said large secondary recrystallized grains defining grain boundaries, said large secondary recrystallized grains each having a [001] axis and a [110] axis, said [001] axis being within about 5° to said rolling direction of said steel sheet and said [110] axis being within about 5° to said direction normal to said sheet; and ii) small grains each having a diameter of about 0.05 to 2 mm, said small grains each having a [001] axis which is at an angle of about 2° to 30° relative to said [001] axis of said large secondary recrystallized grains, said small grains being positioned in said large secondary recrystallized grains or at said grain boundaries defined by said large secondary recrystallized grains.

5. A grain-oriented electromagnetic steel sheet according to claim 4, wherein said small grains have a crystal orientation defined by angles $\alpha$, $\beta$, and $\gamma$ such that the following relations are satisfied:

$\alpha \geqq$ about 2°, $\alpha \geqq$ about $1.5\beta$, and $\alpha \geqq$ about $1.5\gamma$, wherein $\alpha$ is defined as an angle relative to said rolling direction in a plane parallel to said steel sheet, $\beta$ is defined as an angle relative to said rolling direction in a plane normal to said steel sheet, and $\gamma$ is defined as an angle formed in a plane normal to said steel sheet and said plane normal to said steel sheet and being relative to an axis extending normal to said steel sheet and said direction normal to said steel sheet.

* * * * *

UNITED STATES PATENT AND TRADEMARK OFFICE

CERTIFICATE OF CORRECTION

PATENT NO. : 5,702,541

DATED : December 30, 1997

INVENTOR(S) : Yukio Inokuti

It is certified that error appears in the above-indentified patent and that said Letters Patent is hereby corrected as shown below:

In column 1, line 35, please change "St" to --Se--.

In column 2, line 26, please insert --the-- after "by".

In column 7, line 37, please change "β" , first occurrence to --α--.

Signed and Sealed this

Tenth Day of November 1998

Bruce Lehman

*Attest:*

BRUCE LEHMAN

*Attesting Officer*

*Commissioner of Patents and Trademarks*